US006602122B1

(12) United States Patent
Rudolf et al.

(10) Patent No.: US 6,602,122 B1
(45) Date of Patent: Aug. 5, 2003

(54) ELECTRIC POWER TOOL WITH ROTATABLE HANDLE

(75) Inventors: Boris Rudolf, Stuttgart (DE); Manfred Fink, Obersulm (DE)

(73) Assignee: C. & E. Fein GmbH & Co. KG (DE)

( * ) Notice: Subject to any disclaimer, the term of this patent is extended or adjusted under 35 U.S.C. 154(b) by 0 days.

(21) Appl. No.: 09/461,250

(22) Filed: Dec. 15, 1999

(30) Foreign Application Priority Data

Dec. 31, 1998 (DE) ..... 198 60 846
Jan. 8, 1999 (DE) ..... 199 00 404

(51) Int. Cl.[7] ..... B24B 27/08
(52) U.S. Cl. ..... 451/344; 451/357; 451/358; 451/359
(58) Field of Search ..... 451/357, 344, 451/358, 359

(56) References Cited

U.S. PATENT DOCUMENTS

| | | | | | |
|---|---|---|---|---|---|
| 2,373,842 | A | * | 4/1945 | Mitchell | 173/170 |
| 2,775,075 | A | * | 12/1956 | McMaster et al. | 451/241 |
| 3,390,412 | A | * | 7/1968 | Wolter et al. | 451/358 |
| 3,535,829 | A | * | 10/1970 | Dudek | 451/355 |
| 3,907,257 | A | * | 9/1975 | Drzewiecki | 451/358 |
| 3,940,818 | A | * | 3/1976 | Anderson | 15/3.53 |
| 4,641,762 | A | | 2/1987 | Overy | |
| 5,201,146 | A | * | 4/1993 | Fushiya | 451/358 |
| 5,339,572 | A | * | 8/1994 | Eicher | 451/358 |
| 5,407,381 | A | * | 4/1995 | Schaefer et al. | 451/344 |
| 5,466,183 | A | * | 11/1995 | Kirn et al. | 173/170 |
| 5,681,214 | A | | 10/1997 | Kleider et al. | |
| 5,826,478 | A | * | 10/1998 | Zerrer | 451/358 |
| 5,882,249 | A | * | 3/1999 | Ferland | 451/359 |
| 6,048,260 | A | * | 4/2000 | Kopras | 451/358 |
| 6,062,960 | A | * | 5/2000 | Kai et al. | 451/357 |
| 6,120,362 | A | * | 9/2000 | Etter et al. | 451/359 |
| 6,148,931 | A | * | 11/2000 | Nyber et al. | 451/357 |
| 6,186,879 | B1 | * | 2/2001 | Ericsson | 451/358 |

FOREIGN PATENT DOCUMENTS

| | | |
|---|---|---|
| DE | 36 05 116 C2 | 6/1994 |
| DE | 195 46 328 A1 | 6/1997 |
| DE | 198 21 145 A1 | 12/1998 |

* cited by examiner

*Primary Examiner*—M. Rachuba
(74) *Attorney, Agent, or Firm*—St. Onge Steward Johnston & Reens LLC

(57) ABSTRACT

An electric power tool, in particular a right-angle grinder is disclosed, having an elongated motor housing in which an electric motor is received, having a gear drive housing at a first end of the motor housing to receive a gear drive for driving a working spindle, having a handle element which is fastened rotatably at a second end of the motor housing and in which a grip switch is arranged, and having air intake slots to cool the electric motor which are arranged at the second end of the motor housing. In addition, at least one baffle plate, which serves to deflect particles and can simultaneously be configured as a cooling panel for cooling electronic components, is preferably located in the flow region of the air intake slots.

6 Claims, 3 Drawing Sheets

ELECTRIC POWER TOOL WITH ROTATABLE HANDLE

BACKGROUND OF THE INVENTION

The present invention relates to a power tool, in particular a right-angle grinder, having an elongated motor housing in which an electric motor is received, having a gear drive housing at a first end of the motor housing to receive a gear drive for driving a working spindle, having a handle element which is fastened rotatably at a second end of the motor housing and in which a grip switch is arranged, and having air intake slots to cool the electric motor.

A power tool of this kind that is configured as a right-angle grinder is known from the brochure "FEIN Elektrowerkzeuge 1997/98"[FEIN power tools 1997/98] of the applicant, and is marketed under the designation MSfa666.

Right-angle grinders of this kind are common in the form of so-called two-handed right-angle grinders; the handle element, in which a grip switch with a switch button for activating the motor is provided, is grasped with a rear hand, and an additional handle that is configured as a rod handle is held by a front hand. In right-angle grinders of this kind, the fan of the electric motor draws in cooling air through air intake slots that are located in the handle element in the immediate vicinity of the grip switch. This cooling air flows through the electric motor and emerges from the device again through suitable air outlet slots in the region of the gear drive head.

Since right-angle grinders of this kind must often be used for rough work in highly contaminated environments, there exists a risk that dust particles, chips, or the like may be drawn in through the air intake slots of the handle element, possibly resulting in damage to the power tool or at least to an adverse effect on its service life. For example, drawn-in dirt particles can, over time, adversely affect the functionality of the grip switch provided in the handle element, or contaminate the electric motor or even adversely affect its functionality.

SUMMARY OF THE INVENTION

It is an object of the invention to improve a power tool of the kind cited initially in such a way that the risk of contamination of the power tool is reduced.

It is a second object of the invention to provide an electric power tool having improved cooling characteristics. It is a third object of the invention to provide an electric power tool having improved operating reliability.

In a power tool of the kind cited initially, these and other objects are achieved according to the present invention in that the air intake slots are arranged at the second end of the motor housing.

The object of the invention is completely achieved in this fashion. Since the air intake slots are no longer arranged, as in the case of conventional power tools, in the region of the grip switch, contamination of the grip switch and thus any adverse effect on the functionality thereof are prevented. This is additionally assisted by the fact that according to a further embodiment of the invention, means for sealing the motor housing are provided at its second end opposite the handle element.

In an additional development of the invention, the handle part is arranged rotatably with respect to the motor housing. A feature of this kind, known per se in the existing art (cf. DE 195 46 328 A1), makes it possible, for example in the case of a right-angle grinder, for a particularly ergonomic posture to be assumed for both rough grinding and cutoff grinding. Especially if a rotatable handle element of this kind is provided, the arrangement according to the present invention of the air intake slots—outside the handle element in the motor housing—is of particular advantage, since otherwise drawn-in dirt particles could severely contaminate the rotation mechanism and make the handle element difficult to rotate with respect to the motor housing.

According to another embodiment of the invention, the object is achieved, in a power tool of the kind cited initially, in that at least one baffle plate is provided for particle deposition in the flow region of the air intake slots.

The object of the invention is completely achieved in this fashion as well. Specifically, according to the present invention the arrangement of at least one baffle plate immediately in the flow region of the air intake slots results in a deposition of dirt particles, chips, and other contaminants immediately in the air intake region, thus greatly reducing the penetration of impurities into the sensitive areas of the power tool.

If an embodiment of this kind is additionally combined with the features explained previously, i.e. if the air intake slots are arranged at the second end of the motor housing, then at the same time the risk of contamination for the grip switch provided in the handle element is also reduced.

In an additional development of the invention, the baffle plate is configured as a cooling panel for cooling electronic components.

With this feature the impact panel is used in two ways, namely on the one hand for the deposition of dirt particles and other contaminants, and on the other hand to cool electronic components. This results in particularly favorable heat dissipation from electronic components provided in the power tool, and thus in greater operating reliability thereof.

In an advantageous development of the invention, air intake slots are provided at two mutually opposite sides of the motor housing, an insert element being provided, having a baseplate which extends substantially over the cross section of the motor housing and on whose respective sides facing toward the air intake slots an baffle plate is provided.

The advantage of this feature is that a larger cross section for drawing in cooling air is available, and at the same time the insert element guarantees a favorable installation capability for electronic components in the cooling air region.

In an additional development of the invention, the motor housing has, at its end face facing toward the handle element, a circular leadthrough, for the passage of cables to the handle element, that is covered by the baseplate of the insert element, a sealing element for air sealing being provided inside the leadthrough.

This feature guarantees sealing of the motor housing with respect to the handle element even if the latter is received rotatably on the motor housing. A seal of this kind prevents the penetration of dust and other dirt particles into the region of the grip switch located in the handle element, thus enhancing its operating reliability.

According to a further embodiment of the invention, the motor housing has a front and a rear motor housing part, the rear motor housing part containing the air intake slots and the at least one baffle plate.

This feature considerably simplifies the design and assembly of the power tool.

It is understood that the features of the invention mentioned above and those yet to be explained below can be used not only in the respective combinations indicated, but also in other combinations or in isolation, without leaving the context of the invention.

SHORT DESCRIPTION OF THE DRAWINGS

Further features and advantages of the invention are evident from the description below of a preferred exemplary embodiment with reference to the drawings, in which.

DETAILED DESCRIPTION OF THE PREFERRED EMBODIMENT.

Figures 1, 2:
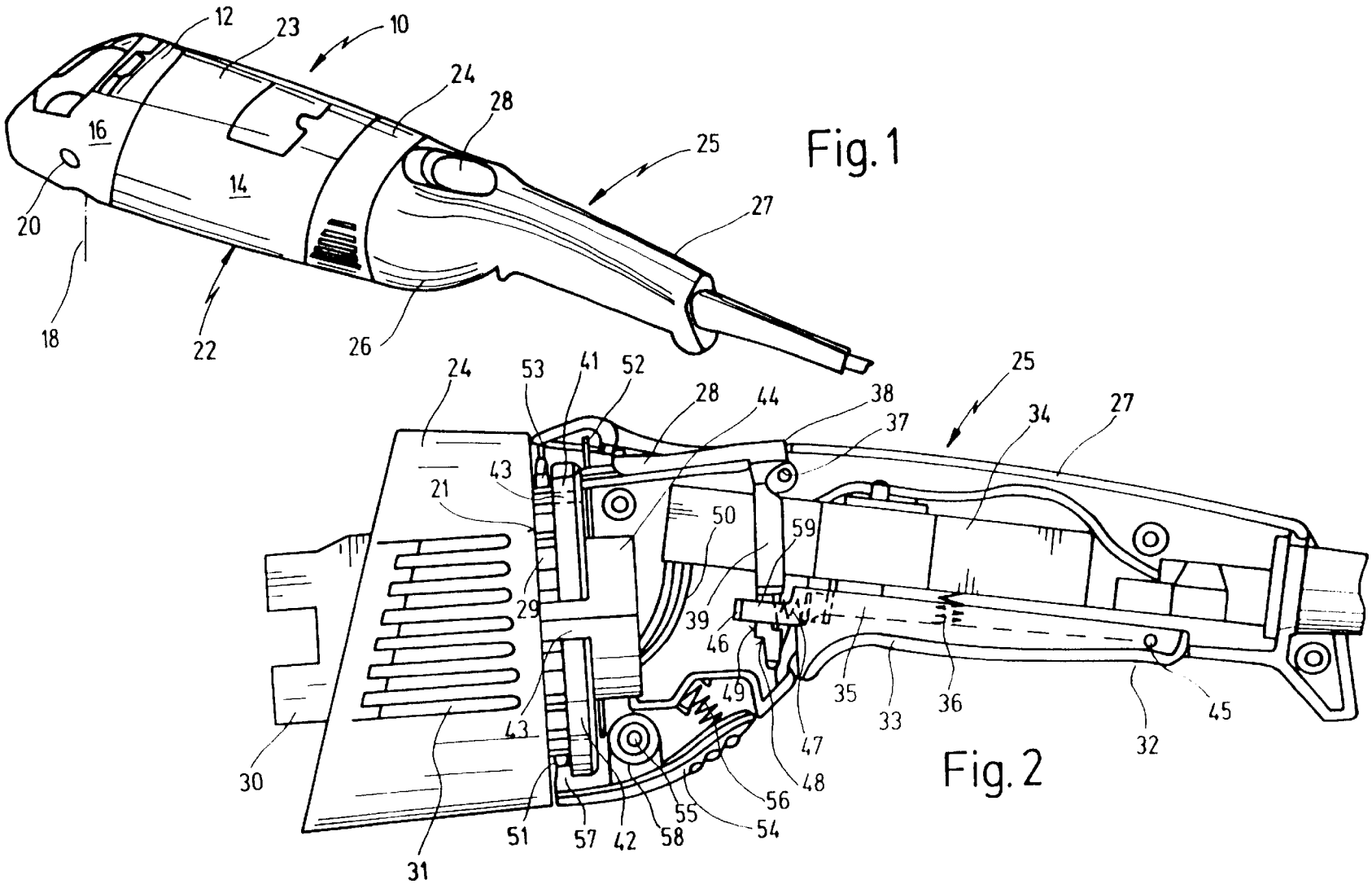
FIG. 1 shows a perspective view of a power tool according to the present invention, using the example of a right-angle grinder.
FIG. 2 shows a view of the power tool as shown in FIG. 1, on which only the handle element and the end of the motor housing facing toward the handle element are visible, one housing half of the handle element having been removed.

In FIG. 1, a power tool according to the present invention is shown in perspective and labeled in its entirety with the number 10. Power tool 10 that is shown is a right-angle grinder, embodied as a so-called two-handed right-angle grinder and having at its rear end a handle element, labeled in its entirety with the number 25, in which a grip switch is provided (cf. FIG. 2). A pushbutton 28, whose function will be explained in more detail below, is provided at the upper end of the handle element.

Power tool 10 furthermore comprises a motor housing, labeled in its entirety with the number 22, that has a front motor housing part 23 to receive an electric motor 14, as well as a rear motor housing part 24 that is adjoined by handle element 25. Adjoining front motor housing part 23 is a gear drive housing 12 in which a gear drive 16 is provided to drive a working spindle that is indicated only schematically with the number 18. Also shown, on the left-hand side of gear drive housing 12, is a receptacle 20 into which a rod-shaped additional handle can be threaded, so that power tool 10 can be held with a front hand on the additional handle and a rear hand on handle element 25.

It is understood that a further receptacle for the additional handle is provided on the opposite, right-hand side of gear drive housing 12, so that power tool 10 is suitable alternatively for right-handed or left-handed operation.

In FIG. 1, the safety shroud that is always provided on a right-angle grinder is not shown for the sake of clarity.

Handle element 25 has a first, left-hand handle housing part 26 and a second, right-hand handle housing part 27, the functions of which will be explained in more detail below.

Handle part 25 can be rotated twice to the left (i.e. counterclockwise), through an angle of 90° each time, from the basic position shown in FIG. 1 in which grip button 33 as shown in FIG. 2 faces downward, and once to the right (i.e. clockwise), through 90°, from the basic position shown in FIG. 1.

This rotation capability makes it possible to switch over between rough grinding, in which a surface is processed in planar fashion with a grinding disk, and cutting, in which a workpiece is cut through with the end surface of a cutoff disk. In addition, because handle element 25 can be rotated 2×90° (i.e. 180°) in one direction, the grip switch can also be rotated onto the upper side of power tool 10. A handle position of this kind is advantageous in particular for rough grinding on ceilings and overhead projections.

The rotation mechanism that makes it possible for handle element 25 to rotate with respect to motor housing 22 and to snap into place in the predefined angular positions is described in more detail below with reference to FIGS. 2 through 4.

In FIG. 2, handle part 25 is shown in an enlarged view together with rear motor housing part 24, left-hand handle housing part 26 having been removed so that the internal configuration, which is shown in somewhat simplified fashion, is visible.

Rear motor housing part 24 has an approximately circular cross section (cf. FIG. 4), and at its front end, which can be fitted together with front motor housing part 23, is cut off obliquely downward, yielding approximately an oblique truncated cone. A plurality of air intake slots 31 are arranged laterally, one above another, on both sides of rear motor housing part 24; and baffle plates 30, whose front ends are visible in FIG. 2 projecting forward out of rear motor housing part 24, are arranged respectively inside rear motor housing part 24 at a small distance from air intake slots 31. The function of these baffle plates 30 will be explained in further detail below.

Rear motor housing part 24 has a central cylindrical stem 44 that projects into handle part 25. This stem 44 serves as a leadthrough 62 (cf. FIG. 4) for the passage of electrical cables 50 between the motor housing and the handle part, and serves also as a rotary bearing for rotatable reception of handle part 25 on rear motor housing part 24. Rear motor housing part 24 has an end surface 21, facing toward handle part 25, to which an annular flange 42 is joined via radially extending webs 29, forming a cavity 51. This annular flange 42 has an outside diameter somewhat smaller than that of rear motor housing part 24 at its end surface, but possesses a much greater diameter than stem 44 which is coaxial therewith.

Figure 4:
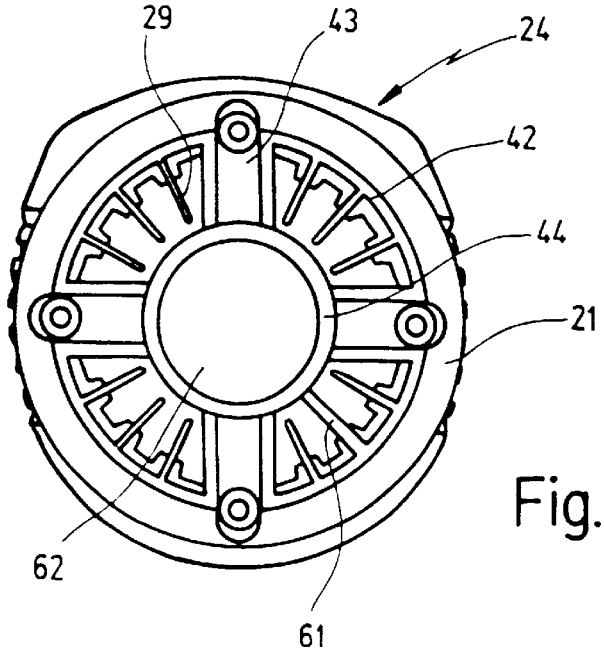
FIG. 4 shows a view of the motor housing from the handle element.

Annular flange 42 has a total of four radial recesses 43 that are each offset by an angle of 90° from one another (cf. FIG. 4).

At these recesses 43, handle part 25 can be snap-locked to rear motor housing part 24, in the angular positions predefined by recesses 43, with the aid of a locking lever 54.

Also provided is an immobilization lever 38 that is received pivotably on a pivot shaft 37 and has, as the first part protruding forward from pivot shaft 37 toward gear drive housing 12, pushbutton 28 on whose front end is shaped a projection 41 that, when aligned with a recess 43, can be introduced thereinto. Immobilization lever 38 furthermore has a second part, joined rigidly to pushbutton 28, that projects downward approximately at right angles to pushbutton 28 and, at its lower end, coacts with grip switch 32.

Grip switch 32 has a grip button 33 that is fastened at the rear lower end of handle element 25 pivotably about a pivot shaft 45. Grip button 33 coacts with a switch module 34 that is arranged above grip button 33, grip button 33 being preloaded downward by a spring 36 and, when moved upward toward a switching pin 35 arranged on the underside of switch module 34, acting to switch electric motor 14 on and off.

Grip button 33 has on its front end, facing toward rear motor housing part 24, an extension 59 on the left and on the right side; these are joined to one another at the outer end by a crosspiece 46, thus forming overall, at the front end of grip button 43, an approximately rectangular opening in which the lower end of second part 39 of immobilization lever 38 is movable to a certain degree.

At its lower end, second part 39 of immobilization lever 38 has a projection 48 that serves as the stop for crosspiece 46 of grip button 33.

Immobilization lever 38 is preloaded, by a spring 47 that acts on second part 39, in such a way that immobilization lever 38 is acted upon clockwise (in the representation of FIG. 2) so that pushbutton 28 is preloaded upward.

In the position shown in FIG. 2, projection 41 of pushbutton 28 aligns with one of recesses 43, so that pushbutton 28 could be transferred into the activation position shown simply by being pushed in. When pushbutton 28 was pushed in, grip button 33 with its crosspiece 46 was moved past projection 48 of second part 39 of the immobilization lever, against the force of spring 36, so as thereby to actuate switch module 34 in order to switch on power tool 10.

Once this position has been reached, pushbutton 28 can be released, since immobilization lever 38 is prevented from pivoting back out of its activation position into its rest position, in response to the force of spring 47, by the fact that a front surface 49 of second part 39 of immobilization lever 38 comes to a stop from the inside against crosspiece 46 of grip button 33.

The result is thus a continuous operation position in which grip button 33 simply needs to be continuously grasped in order to allow continuous operation with power tool 10.

If grip button 33 is then released from this position shown in FIG. 2, grip button 33 then moves downward in response to spring 36 so that its crosspiece 46 is moved past projection 48 of second part 39 of immobilization lever 38, and immobilization lever 38 is then pivoted out of its activation position, in response to spring 47, into its rest position or starting position. Once this position has been assumed, grip button 33 can no longer be moved upward, since crosspiece 46 is stopped against projection 48 of second part 39 of immobilization lever 38.

When the motor is to be switched on, pushbutton 28 therefore must first be pressed, causing immobilization lever 38 to pivot counterclockwise (as shown in FIG. 2) so that grip button 33 with its crosspiece 46 can now be pivoted upward past projection 48 in order to actuate switching pin 35 of switch module 34.

Figure 3:
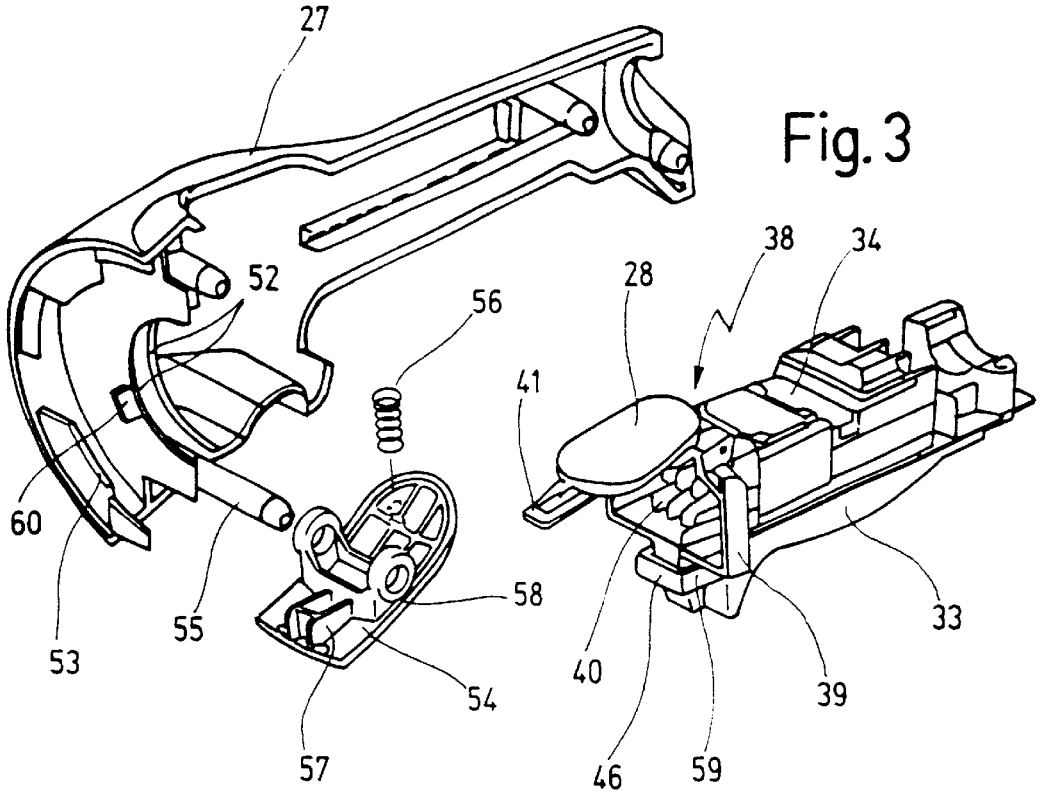
FIG. 3 shows an exploded view of the right-hand housing half of the handle element with the locking button and associated spring, and of the grip switch that is assembled with the immobilization lever into one unit.

Also visible in FIG. 2 at the lower end of handle element 25 is locking lever 54, which is received with a receptacle 58 pivotably on a pivot shaft 55 of the second or right-hand handle housing part 27 (cf. also FIG. 3). This locking lever 54 is preloaded by a spring 56 in such a way that when handle element 25 is aligned with one of the radial recesses 43, it can engage with a projection 57 into the relevant recess 43 on rear motor housing part 24, and handle element 25 can thus be prevented from rotating with respect to rear motor housing part 24.

The effect of locking lever 54 is to make any rotation of handle element 25 with respect to motor housing 22 possible only if locking handle 54 is deliberately pressed. Handle element 25 can then be rotated until, after a rotation through 90° or a multiple thereof, locking lever 54 is once again aligned with a radial recess 43 of annular flange 42, and projection 57 of locking lever 54, in response to spring 56, engages with its projection 57 into radial recess 43 of annular flange 42 and locks handle element 25 against any further rotation. The function such that handle element 25 is locked in a predefined angular position on motor housing 22 is thus decoupled from the function of pushbutton 28, which serves as an activation lock to prevent the electric motor from being switched on unintentionally.

Handle element 25 is guided on the one hand on stem 44 by webs 52, 53 projecting inward from the two handle housing parts 26, 27, and on the other hand on annular flange 42. As is evident from FIG. 3, right-hand handle housing part 27 has two mutually parallel annular webs 52 that effect a first guidance on the surface of stem 44, and also has on its end facing toward rear motor housing part 24 a plurality of annular web segments 53, running in the circumferential direction, that engage into the cavity 51 between end face 21 and annular flange 42.

Since annular flange 42 is joined via individual radially extending ribs 29 to end face 21 of rear motor housing part 24, the result is thus a decreased contact surface for webs 53 and, in combination with webs 52 which run parallel to one another and rest on stem 44, extremely reliable rotary guidance for handle element 25 on rear motor housing part 24, but with a relatively low frictional resistance.

Also provided, between handle element 25 and rear motor housing part 24, is a rotation angle limiter that is constituted by a projection 60 on right-hand handle housing part 27 (cf. FIG. 3) and by a radial rib 61 (cf. FIG. 4) on rear motor housing part 24 that extends between stem 44 and the outer rim of annular flange 42. Handle part 25 is thereby prevented from rotating 360° or more in one direction.

Figure 5:
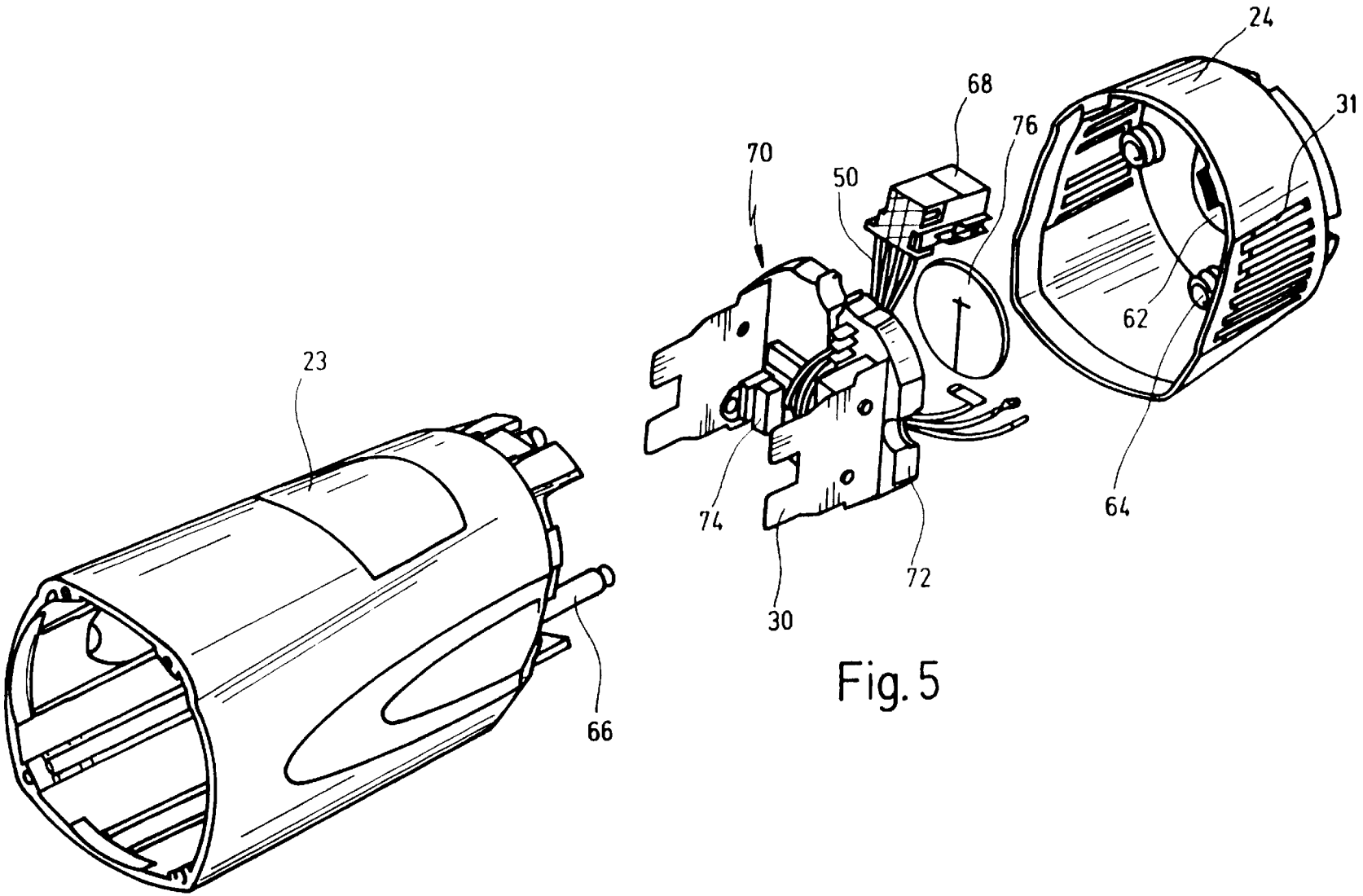
FIG. 5 shows an exploded representation of the motor housing with the front motor housing part, rear motor housing part, and an insert element for the rear motor housing part with accessories.

Front motor housing 23, rear motor housing part 24, and an insert element 70, with accessories, that can be slid into rear motor housing part 24 are shown in FIG. 5 in an exploded view and are explained in more detail below.

Front motor housing part 23 serves to receive electric motor 14. Rear motor housing part 24, on the other hand, receives insert element 70, which comprises a baseplate 72, extending over the cross section of motor housing part 24, on which electronic components 74 for controlling power tool 10 are encapsulated and on whose left side and right side a respective baffle plate 30 made of sheet aluminum projects forward.

When power tool 10 is operated, cooling air is drawn in through air slots 31 on both sides of rear motor housing part 24; it first strikes baffle plates 30 arranged directly behind air intake slots 31, causing the deflection of dust particles and other contaminants that might also be drawn in when working in a heavily contaminated environment. (The air emerges again through air slots (not shown) in the region of gear drive housing 12.) This arrangement has an advantageous effect on the service life of electric motor 14. Baffle plates 30 are moreover simultaneously configured as cooling elements for some of the electronic components 74, so that they are additionally cooled by the drawn-in air flow. This contributes to the operating reliability of electronic components 74.

Whereas in conventional right-angle grinders the air intake slots were previously located in handle element 25, i.e. in the immediate vicinity of grip switch 32, air intake slots 31 are now provided in rear motor housing part 24 in a manner separated in terms of flow engineering from handle part 25. Leadthrough 62 for cables 50, which are equipped with a plug connector 68 for connecting to corresponding connector pins 40 on switch module 34 (cf. FIG. 3), are largely closed off by baseplate 72 of insert element 70. In addition, a flexible sealing disk 76, which is slid onto cables

50 and is located together with them inside leadthrough 62 of stem 44, is provided in order to seal them additionally even when handle part 25 is rotated.

This prevents contaminated air from ending up in the vicinity of grip switch 32 and thus prematurely degrading its functionality.

Production and assembly are considerably simplified by the fact that motor housing 22 is configured in two parts with a front motor housing part 23 and rear motor housing part 24. Insert element 70, with electronic components 74 and baffle plates 30, is inserted into rear motor housing part 24, while electric motor 14 is installed in front motor housing part 23; then the two components are immovably joined to one another by threading screws, located in screw holes 64 in rear motor housing part 24, into screw receptacles 66 in the form of pegs on front motor housing part 23.

What is claimed is:

1. An electric power tool comprising:

an elongated motor housing having a first end and a second end;

an electric motor received within said motor housing;

a gear drive housing attached to said first end of said motor housing;

a gear drive received within said gear drive housing and being driven by said electric motor;

a working spindle driven by said gear drive;

a handle element received rotatably at said second end of said motor housing;

a grip switch arranged on said handle element for providing electric power supply to said motor;

a plurality of air intake slots arranged on the motor housing within the proximity of the second end thereof, said air intake slots provided at two mutually opposite sides of said motor housing and allowing the entering of cooling air into the motor housing; and an insert element insertable into said motor housing, said element having a baseplate which extends substantially over a cross section of said motor housing, said baseplate carrying at least one baffle plate on each side facing toward said air intake slots provided on both opposite sides of said motor housing, wherein said baffles plates are arranged within said motor housing within a flow region of air flowing into said motor housing through said air intake slots for effecting deposition of contaminant particles within said air flowing into said motor housing.

2. The electric power tool as defined in claim 1, further comprising a seal for sealing said motor housing at its second end against said handle element.

3. The electric power tool as defined in claim 1, further comprising at least one electronic component coupled to said baffle plate.

4. The electric power tool as defined in claim 1, wherein said motor housing comprises an end face facing toward the handle element at its second end, said end face having a circular leadthrough for the passage of cables between the handle element and motor housing.

5. The electric power tool as defined in claim 4, wherein said circular leadthrough is covered by said baseplate of said insert element, a sealing element being provided inside the leadthrough for air sealing said motor housing against said handle element.

6. The electric power tool as defined in claim 1, wherein the motor housing comprises a front motor housing part and a rear motor housing part, wherein said air intake slots and said at least one baffle plate are provided on said rear motor housing part.

* * * * *